US006506465B1

(12) United States Patent
Sloot

(10) Patent No.: US 6,506,465 B1
(45) Date of Patent: Jan. 14, 2003

(54) DECORATIVE TOPPERS

(75) Inventor: Alexander Sloot, Sugarloaf, PA (US)

(73) Assignee: Printmark Industries, Inc., Hazelton, PA (US)

( * ) Notice: Subject to any disclaimer, the term of this patent is extended or adjusted under 35 U.S.C. 154(b) by 0 days.

(21) Appl. No.: 09/318,147

(22) Filed: May 25, 1999

(51) Int. Cl.[7] ..... B43K 29/00

(52) U.S. Cl. ..... 428/40.1; 401/88; 428/41.7; 428/42.1; 428/192; 428/194; 428/352; 446/222; 446/226

(58) Field of Search ..... 428/40.1, 41.7, 428/42.1, 192, 194, 352; 446/222, 226; 401/88

(56) References Cited

U.S. PATENT DOCUMENTS 5,588,532 A * 12/1996 Pharo ..... 206/522
5,639,523 A * 6/1997 Ellis ..... 428/34.2
6,155,901 A * 12/2000 Chen ..... 446/224

* cited by examiner

*Primary Examiner*—Nasser Ahmad
(74) *Attorney, Agent, or Firm*—St. Onge Steward Johnston & Reens LLC

(57) ABSTRACT

A decorative topper is formed of a laminate of plastic and other suitable materials by RF energy which seals a major portion of a peripheral edge. At least one portion, e.g., one or more edges, is not sealed closed in the original forming of the product. The portion that remains open provides will slide over an object to be decorated. At the opening is a release paper, preferably on both surfaces of the topper, which release paper covers a pressure sensitive adhesive. The process is especially advantageous due to its ability to cut and seal the peripheral edge except at the opening where the material is cut but not sealed.

12 Claims, 5 Drawing Sheets

FIG. 5b
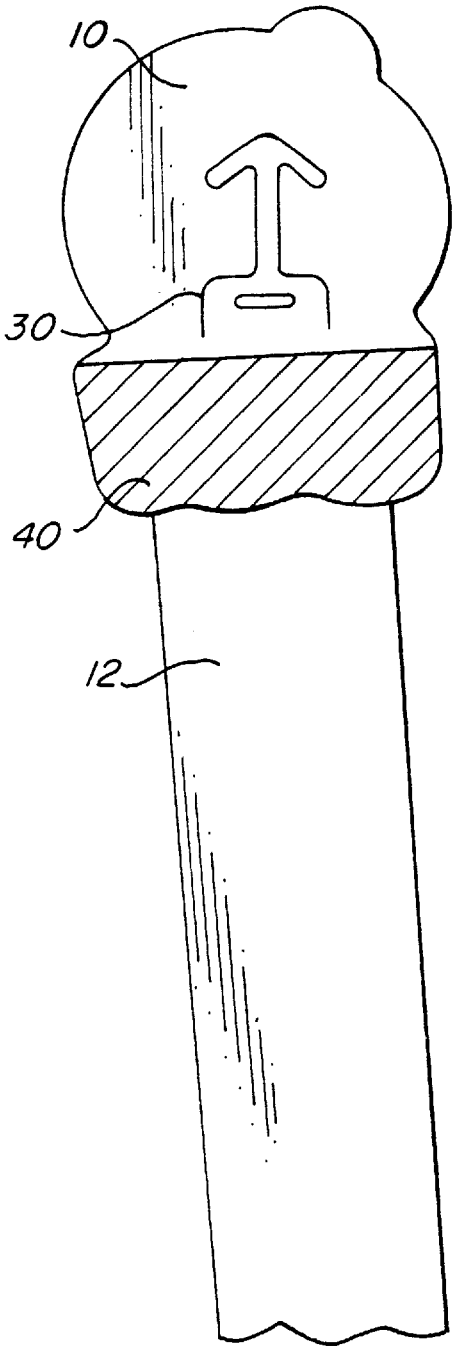
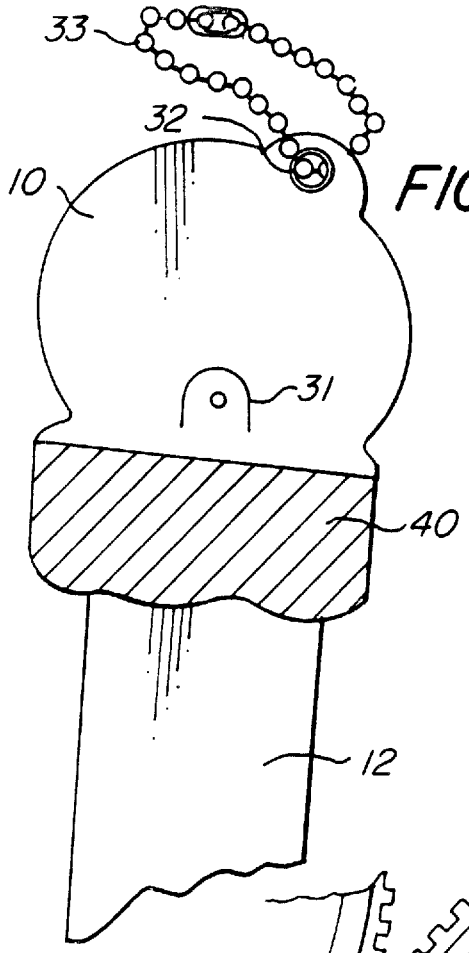
FIG. 5c
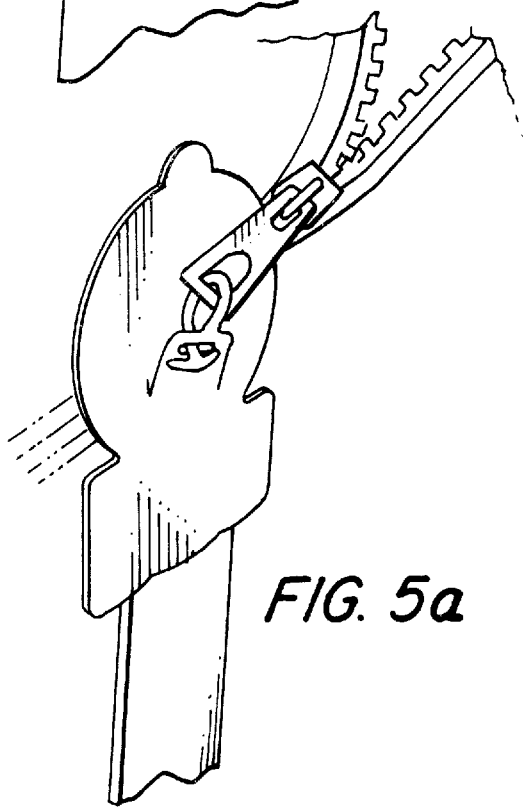
FIG. 5a

DECORATIVE TOPPERS

BACKGROUND OF THE INVENTION

The invention relates to a decorative self-adhering novelty called a topper, and more particularly to such a novelty that can be adhesively applied to a variety of articles. For example, they can be applied to an edge or partially extend over flexible or rigid articles. Uniquely, the toppers of the invention are well adapted to fit over articles of the type comprising stems, shafts, posts, narrow flat objects and the like.

Known in the art are stem-like articles such as pencils, pens, markers and other writing instruments. Other stem-like items are toothbrushes. Also known are other articles such as plain wooden dowel sticks, flat wooden objects such as wooden rulers, and flat metal items such as metal rulers. Also well known as flat self-coiling products such as wristband-type spring bands. The toppers can also be applied to any article having a free edge that will effectively hold the article by adhesion.

The usual methods for decorating these types of articles would typically be to print on the surface of the products by methods such as pad printing, screen printing offset printing, painting, dipping into a color base, embossing, heat transfer application, hot foil stamping, metal stamping, laser burning and other commonly used methods of embellishment.

These methods of decoration require that the decoration be applied to the surface of the article and will be restricted in size by the size of the article. However, sometimes a secondary decorative part can be made separate from the product and then glued or otherwise bonded to the product. This will generally comprise of a nameplate, a plastic part, a sticker or other single piece which may simply have adhesive applied to its underside, and then adhered directly to the original article. One example is shown in U.S. Pat. No. 5,582,888 to Volkert, which shows the preparation of popup articles having an adhesive at edge locations. The process of making these articles requires several cutting steps. U.S. Pat. No. 5,729,834 shows inflatable applique articles for adhesion to fabric. See also, U.S. Pat. No. 5,251,337 to Sloot. These articles include the use of adhesives, but they are made for application to one surface of fabric articles.

Generally, to decorate both sides of a product, one would need to apply two stickers, or two nameplates, or employ two print passings. In U.S. Pat. No. 4,728,212, Spector shows a novelty item for slipping over the top of a pen, but the articles must be molded to fit the given article.

What is desired therefore is a quick, simple, easy-to-apply decorative topper that can slip over the top of various objects and be adhered with no mess, be relatively permanent, and can be adjusted into its final position before the adhesive grips the surface of the article. Also desired is a simple and economical process for making articles of this type.

SUMMARY OF THE INVENTION

Accordingly, it is an object of the present invention to provide a decorative novelty, such as a topper which can be easily applied to various articles with some degree of permanence, so the article can be sold as a fully decorated article, or the topper can be sold as a slip-on topper for application in the consumer marketplace. The toppers should be able to be applied in one easy step.

Still another object of the invention is to provide a decorative topper wherein the decorative portions can have a variety of shapes. The shape can create a topper that fits within the size of the article which it is decorating, or it may extend laterally from the article which it is decorating.

It is still another object of the invention to provide a topper where, during the manufacturing process, two pieces of material as well as two layers of adhesive can be formed and cut out in one step, but where the two ends which need to remain open, remain so and do not seal together.

Another object of the invention is to provide a topper that can be affixed to desired articles in one easy step, but can be moved around, positioned, and adjusted before the adhesive grabs hold.

Yet another object of the invention is to create a topper which is made from a pre-formed decorated thermoplastic, so as to create a very three-dimensional topper.

Yet another object of the invention is to provide a simple and economical process for making articles of this type.

Yet another object of the invention is to provide composite articles comprising a base article and a topper.

These and other objectives are achieved by the invention, which provides a decorative topper, a method for making such a topper and a composite of a base article and a topper. The decorative toppers are laminates of plastic and other suitable materials, sealed around a major portion of a peripheral edge but include at least one portion, e.g., one or more edges, that is not sealed closed in the original forming of the product. The portion that remains open provides the area that will slide over the object to be decorated. At the opening is a release paper, preferably on both surfaces of the topper, which release. paper covers a pressure sensitive adhesive.

In one embodiment, the decorative hollow article comprises: at least two sheets of flat, heat-sealable stock having an adhesive on a portion of said sheets, said adhesive covered by a release material; a seal along a peripheral edge of said at least two sheets of flat, heat-sealable stock thereby forming a hollow cavity, open along a portion of the periphery, wherein the adhesive covered by the release material is located at an opening formed at a portion of the periphery that is not sealed.

The process for producing a shaped, decorative hollow article of the invention, in one aspect comprises: providing at least two sheets of flat, heat-sealable stock having an adhesive on a portion of said sheets, said adhesive covered by a release material; laying the sheets together such that the release material on each is overlapped with the release material on the other; placing the sheets in contact with a shaped sealing die and plate to form the hollow article having a peripheral edge which is sealed about its major extent, except in the area of the release material.

In one embodiment in accordance with the invention, a first layer of vinyl bearing a decorative printing on one side overlays a second vinyl layer which may be reflective, or glow in the dark, or holographic or have some other background of an interesting nature.

In another embodiment, the back of the topper could also be printed or otherwise decorated, and in yet a further embodiment, the back of the topper can have an adaptation such as a zipper pull clip.

With a decoratively-shaped topper in accordance with the invention, a great variety of shapes can be achieved and made in an economic manner and made available with attractive appearances and/or reflective features as seems desirable.

One preferred article onto which to attach a shaped topper is a self-coiling vinyl-covered wristband. Also preferred is a pencil or other writing instrument. In the case of a self-coiling wristband, the wristband may have a flocked backing material for user comfort. Similarly, the topper can also have a backing made of a flocked material. The wristband for example can be made of a reflective vinyl for user safety. The top surface of the topper can also be made of a reflective material. These toppers may also be applied over auto antennas for decoration, to find one's car easily in a parking lot, or if reflective, for safety purposes.

In addition, a topper may be adhered to the top of a jacket lapel, and held on from front and back, it will not have a tendency to fall forward. For some applications, the adhesive will be selected for easy, clean release.

The invention and its particular features will become more apparent from the following detailed description considered with reference to the accompanying drawings.

BRIEF DESCRIPTION OF THE DRAWINGS

FIG. 5*a* is a back view showing the topper adapted to a zipper pull, FIG. 5*b*and FIG. 5*c* show other configurations on the backs of toppers.

DETAILED DESCRIPTION OF THE INVENTION

Figure 1A:
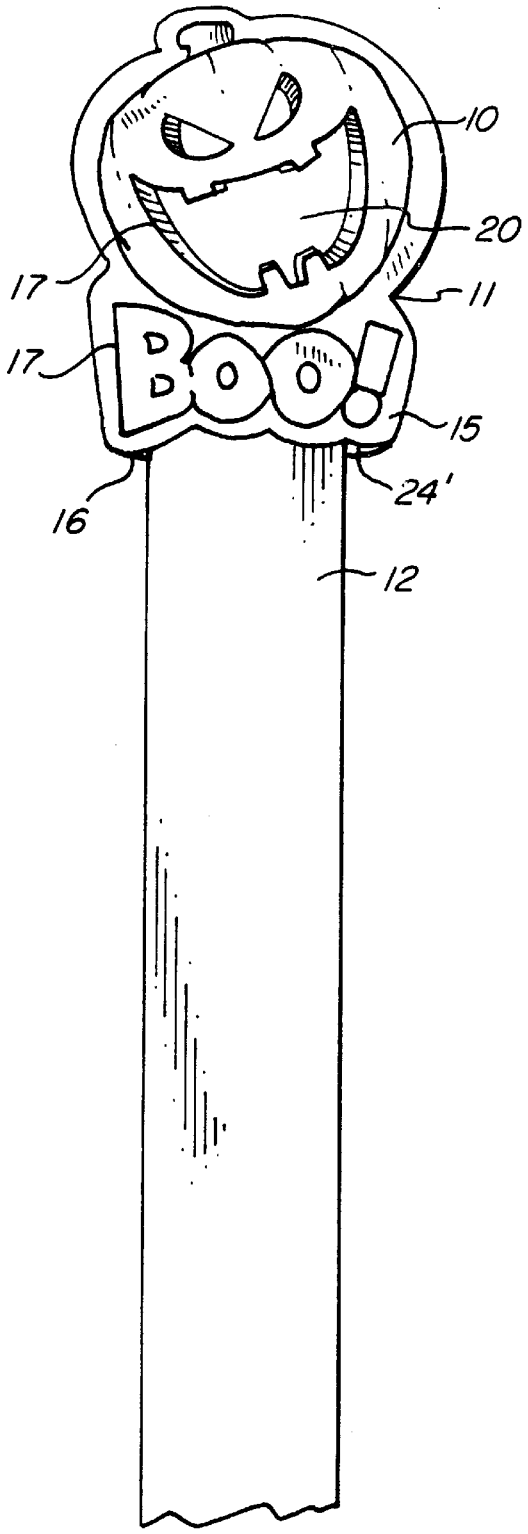
FIG. 1*a* is a front elevation of one embodiment of a contoured topper shown on an open self-coiling wristband.

FIG. 1*a* shows the shaped topper 10 in accordance with the present invention attached to a stem-like object 12. While the decorative self-sticking topper 10 is most likely to be used on a flat stem-like objects 21, it is understood however that self-adhering toppers can be applied to any correctly-sized article, be it small like a pencil, or large like a 36" ruler, hand-held wooden or metal pole and the like.

Figure 1B:
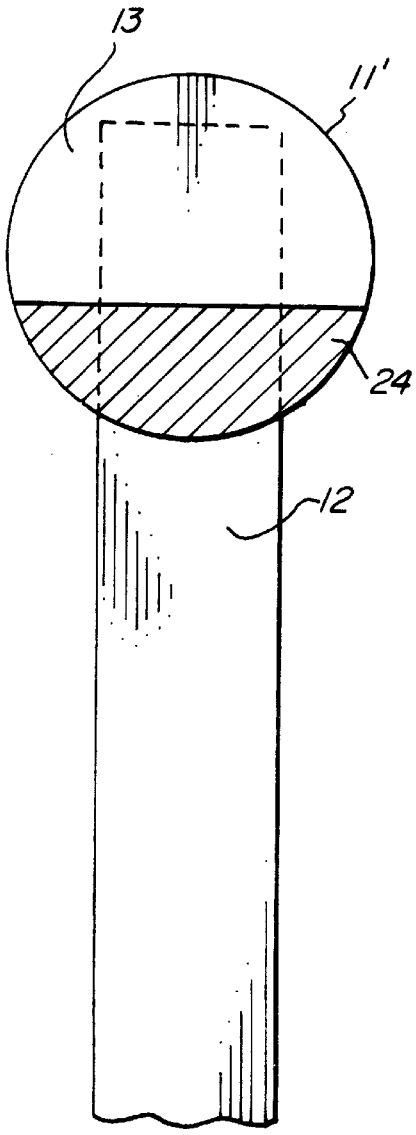
FIG. 1*b* is a similar view of a round topper.

The topper 10 may be a contoured shape 11, or a generic shape 11' in FIG. 1*b*, such as a circle or rectangle. A colorful decoration or interesting design 17 may appear on the one or both sides of the topper. In areas not covered by ink or design, a surface finish 20 may show through such as a reflective material, a glow element, glitter holographic background, or other similar interesting features.

The topper has an upper hollow "pocket" area 13 (seen clearly in FIG. 3), and an adhesive area 24 (shaded area in FIG. 1*b*) along its base. An upper adhesive-backed flap 15 and a lower adhesive-backed flap 16 will hold the topper to the stem-like article.

These toppers may be made from any flexible thermoplastic materials such as flexible PVC (vinyl), polyurethane, polyethylene, polypropylene, and other similar materials. Generally in the range of 0.005" to 0.010" in thickness. They may be made from expanded PVC, cloth-backed PVC, flocked-backed PVC, and these variations applied to the other thermoplastics as described above. Some rigid materials such as rigid PVC or polyester will also be suitable for this product in the same thickness range. However, the most preferable material is flexible PVC, because the manufacturing method of RF sealing works best with this material as will be described later on.

Figure 2:
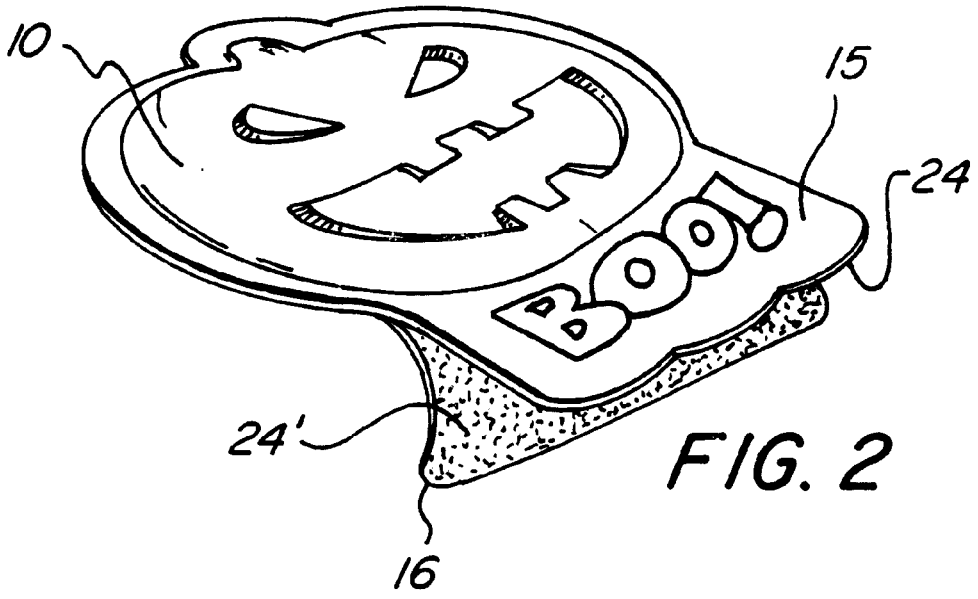
FIG. 2 is a side perspective view of a shaped decorative topper.

FIG. 2 shows the shaped topper 10 with its lower portion partially open, which contains a pressure sensitive adhesive 24 on the inside of the top surface, and 24' on the inside of the lower surface. Adhesive 24 occurs on the back of flap and adhesive 24' on the back of flap 16. This adhesive runs along the lower part of the topper in a proportion of about 25% to 35% of the total height of the topper. The rest of the inside "pocket" 13 of the topper, does not have any adhesive. In accordance with the present invention, the topper will easily adhere to the flat article 12 (FIG. 1*b* shows insertion in dotted lines), with only 25% to 30% of its inner surface area having an adhesive.

Figure 3:
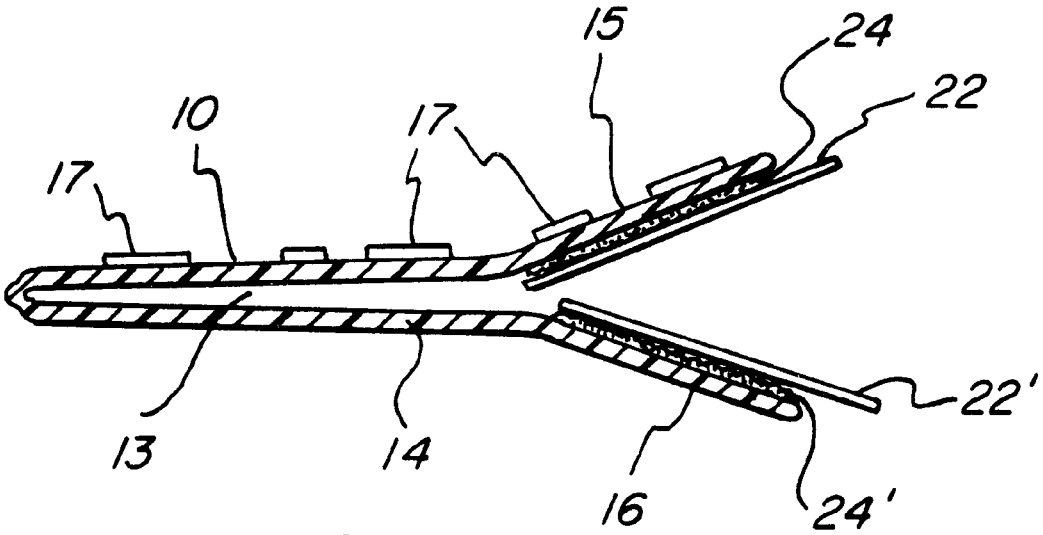
FIG. 3 is a side sectional view showing the decorative topper.

FIG. 3 in accordance with the invention is a side sectional view of a topper as that shown in FIG. 1*a*, taken along a longitudinal centerline. The topper 10 will have a (hollow) pocket area or chamber 13, which is sealed on 3 sides (around most of the periphery, leaving an open portion). A printed decoration 17 may occur on the front and/or back of the topper. Adhesive 24 on the back of flap 15 is shown, with its release liner 22 still intact and extending beyond the sealed product. Similarly adhesive 24' is shown on the back of flap 16 with its release liner 22' extending beyond the product.

The topper is generally made up of one or more layers of a thermoplastic material such as flexible vinyl. These layers combined are shown as being material 14, but how they are made up and sealed together will be covered later. The three edges of the flaps 15 and 16 comprise the material layers sealed together and finished according to the die shape. However, 15 and 16 are not sealed to each other, but they remain apart to form an opening in the topper and to become the flaps.

It should be understood that the front and back materials may be the same or they may be different. For example, the front of the topper on a self-coiling wristband can be of a reflective material for user safety, but the back may be a flocked vinyl to match the back of the wristband. The inner layers, if needed, can be of any compatible vinyl support material to help with the product function.

Figures 4A, 4B:
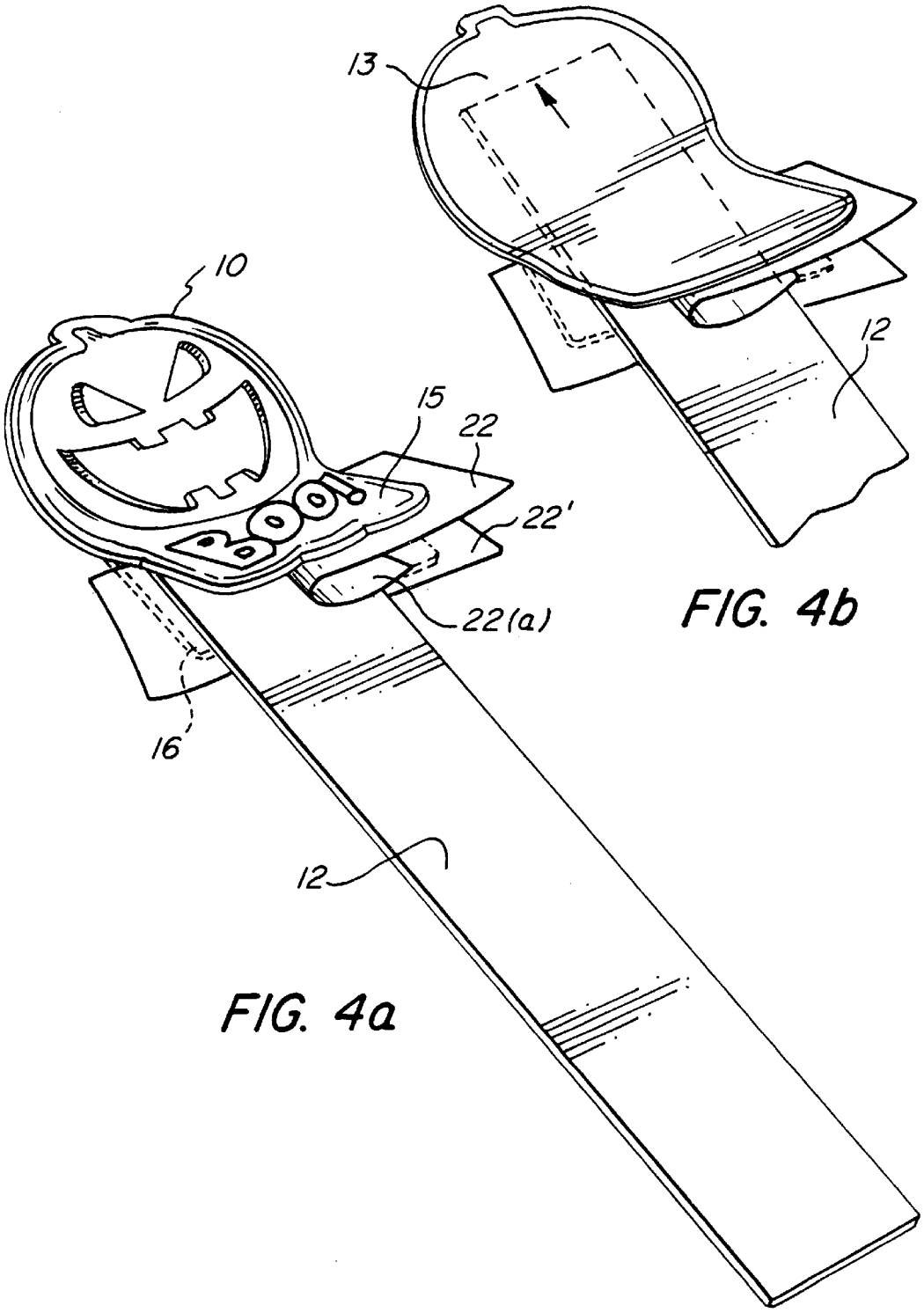
FIG. 4*a* is a side and top perspective view showing flaps open for attachment, release paper and the adhesive.
FIG. 4*b* shows one of the release papers being peeled for application.

FIG. 4*a* shows a topper 10 being applied to the flat stem-like article 12. For this application, the article will be inserted into the topper, past the top and bottom adhesive-backed flaps, and inserted all the way into the open chamber 13. The intact release liners 22 and 22' on the back of flaps 15 and 16 will allow the article to easily slide into the topper without the adhesive grabbing hold. Once the article is fully inserted, then flap 15 can be lifted upwards in a hinge-like fashion, and the release liner 22 can be peeled back, (shown as 22*a* in FIG. 4*a*). This will expose the adhesive 24. The flap 15 is then pressed down firmly onto the flat stem-like article 12. Similarly the release liner 22' is removed from the back flap 16, and this flap also is firmly pressed onto article 12.

Note that in the most preferable design of the topper, the edges of the flaps protrude beyond the sides of the article, so that when both flaps are pressed onto the article, the two protruding adhesive areas 22 and 22' will come into contact and will adhere to one another. They will adhere very strongly because two adhesive surfaces produce twice as much adhesive strength. Both of these flaps conform exactly in shape to each other, so they will finish off the outer edges of the topper in an aesthetically pleasing way. What were open flaps, now become contoured and sealed smooth edges like the rest of the topper.

FIGS. 5*a*–5*c* illustrate several adaptations on the back of the toppers. While the topper 10 can be decorated 17 on one or both sides, the back of the topper can have some interesting protrusions, projections or adaptations. FIG. 5*a* shows the topper adhered to a flat self-coiling wristband 12. The back of the topper can have a built in cut-out arrow shaped stem 30. This stem curls around and threads into itself so it can form a locking loop. It can, for example, be used as a zipper pull on a jacket as seen in FIG. 5*a*. The back of the topper can have another pre-cut protrusion 31 which pops out and can take a hook or key ring. Similarly, a hook, key ring or ball chain (shown as 33) can be hooked through hole 32 at the apex of the topper. Ideally, when creating a pre-cut stem 30 or aperture 31, these must be so located that they are above the adhesive field 40. This way, they can be flapped open away from the topper in order to function properly.

Figure 6:
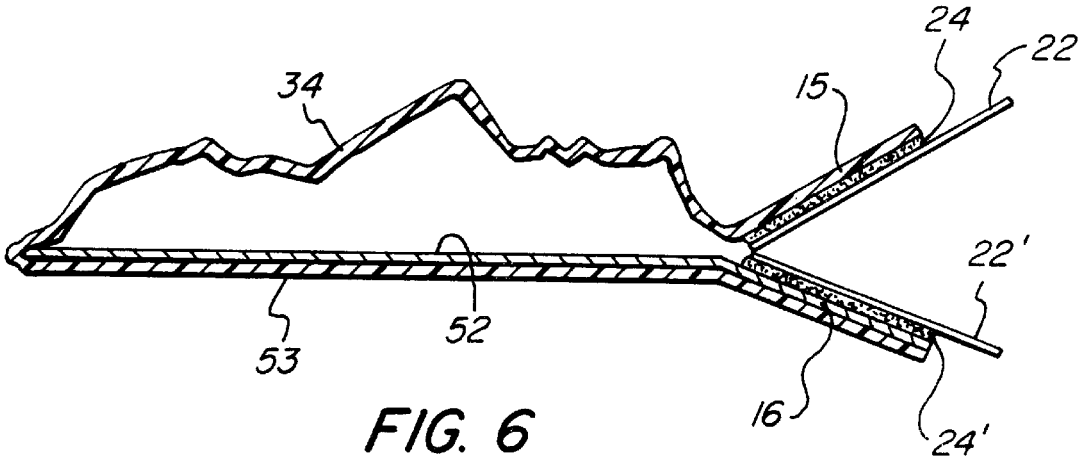
FIG. 6 is a side sectional view showing a pre-formed (molded) version of the topper.

FIG. 6 is a side sectional view of a pre-formed topper. The toppers may be made from preformed materials. These once again can be flexible or rigid depending on the desired result.

An expanded, PVC works well for a flexible finish, and it may be printed or unprinted. The most preferable method of forming the shape is vacuum forming, but that is not the only method. Injection molding, blow molding and other methods may also be used to pre-form the top layer.

A pre-formed top layer 34 will have the adhesive strip applied in the standard manner, and this part will be placed over backing layers 52 and 53. All are then sealed using preferably RF and will bond together like the standard toppers. The sealing die 60 will need to be of a deep enough configuration so as not to harm the preformed top layer 34. It is of course possible to have the back of the topper also preformed. Thus, the topper can be dimensional on both sides of so desired.

Figure 7:
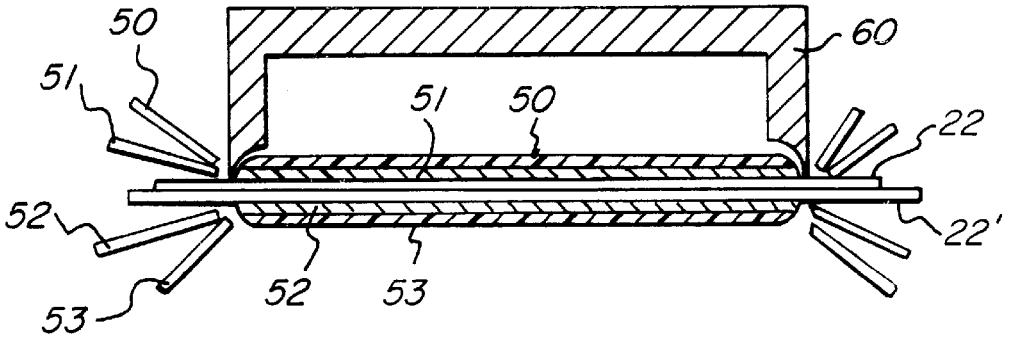
FIG. 7 is a side sectional view of the topper being made with an RF sealing die, top and bottom excess material being cut away simultaneously.

FIG. 7 illustrates a preferred method of manufacture and the valuable role of the release liner.

The preferable material from which to make the toppers is flexible vinyl also known as PVC. To make a basic topper, a top layer 50 consisting of a clear vinyl material will generally be screen printed, foil stamped or in some way decorated. It may be printed on its underside for better abrasion resistance. It is preferable, but not essential, that a second layer be included for both the top and bottom materials. So, below 50 will be placed on a second sheet of vinyl 51 which may be an opaque color, a reflective layer, glow material, or be of another desired finish. These two will form the top two layers.

The next sheet in line 52 will be the inner layer of the lower section and finally the bottommost layer 53. If a stem protrusion such as 30 is required, then 52 and 53 will be sealed together to form this protrusion prior to them being married to the top two layers.

Onto the two inner sheets 51 and 52, a strip of transfer adhesive is applied in a desired position. Release liner 22 and 22' will remain intact on both adhesive strips. Upper sheet 51 will receive adhesive 24, and lower sheet 52 will receive adhesive 24'. Both adhesives may be identical, but on occasion they may each be of a different construction if a special bonding is needed.

The sheets 50, 51, 52, and 53 are all placed in position into an RF sealing machine with one or multiple images to be sealed at the same time. The head of the machine comes down with a specially contoured die 60 in position. The RF sealing process will cause all the layers to be sealed together, and all excess material will automatically cut away.

However in the middle of the sandwich are the two release liners. The die descends onto the materials, and seals all four layers together around their perimeters. On top of release liner 22 vinyls 50 and 51 will bond. Below release liner 22', vinyls 52 and 53 will bond.

However, an unusual phenomenon occurs here. Upper layers 50 and 51 will bond to each other, and lower layers 52 and 53 will bond to each other. The presence of the release liners will not permit 50/51 and 52/53 to bond together, i.e. all four together, like the rest of the topper perimeter. The release liners are there to cover the adhesive, but their presence acts as a sealing barrier as well, to preserve the opening into the topper's chamber.

Not only do the silicone-coated release papers 22 and 22' prevent the two sides from being sealed closed, but they act as a buffer against which the sealing die 60 can exert current and pressure, so that the areas to be left open are cut away during the sealing step exactly like the areas which are sealed together.

A second phenomenon also occurs. It is understandable that the die will cut away excess material of the top two layers 50/51 because the die is in direct contact with the top layers. However the excess material of the bottom two layers 52/53 also cuts away during this step, even though the die is going through two release liner layers. This allows the 50/51 bonded upper layer and the 52/53 bonded lower layer to be of identical perimeter shape. Thus, when these two pairs adhere together along their outer edges as described above with regard to FIG. 4, they will contour perfectly.

A number of very advantageous things happen in one sealing process:

1. The perimeter of most of the topper is sealed, bonding two or more materials together.
2. In two select flap areas only, the top two and the bottom two materials bond in pairs, but not to each other. This provides the needed opening.
3. While these two groups bond in the flap areas, all excess materials are cut away, both top and bottom, in spite of the release liners, thus finishing off the product in one instant, i.e., one application.
4. An automatic opening is created into which can be inserted a stem.
5. The adhesive covered by release liners will remain unexposed, awaiting the final application.

The method of keeping the two adhesive flap areas covered while the stem is inserted is also an integral part of this invention. The stem can be inserted into the topper in varying degrees of distance. It can be freely adjusted without being hampered by the adhesive. Having the stem and topper fully engaged may be the most preferable situation. The fact that the release liners can easily be peeled off once the stem is inserted, is another advantage of the invention.

Toppers may be interchangeable. The flaps can be pried apart with some degree of difficulty, but the topper can be removed and another one attached to the stem-like article.

The above description is intended to enable the person skilled in the art to practice the invention. It is not intended to detail all of the possible modifications and variations that will become apparent to the skilled worker upon reading the description. It is intended, however, that all such modifications and variations be included within the scope of the invention which is defined by the following claims. The claims are meant to cover the indicated elements and steps in any arrangement or sequence which is effective to meet the objectives intended for the invention, unless the context specifically indicates the contrary.

What is claimed is:

1. A decorative hollow article comprising:

at least two sheets of flat, heat-sealable stock, each of the sheets being provided with an inner side having an adhesive on a portion thereof;

two removable liners, each covering the portion of the respective inner side with the adhesive;

a seal along a peripheral edge of said at least two sheets of flat, heat-sealable stock thereby forming a hollow cavity with an opening in said seal along the peripheral edge located approximately at the portions of the inner sides for permitting sliding engagement of an article into the hollow cavity.

2. A decorative hollow article according to claim 1 wherein a first decorative layer of a transparent material is located over another layer which second layer is of a reflective material.

3. A decorative hollow article according to claim 1 wherein the decorative hollow article is of a geometric shape selected from the group consisting of a circle, a rectangle, a square, and combinations thereof.

4. A decorative hollow article according to claim 1 wherein the decorative hollow article is shaped to correspond to a particular design of a character or object.

5. A decorative hollow article according to claim 1 wherein the decorative hollow article is printed or otherwise decorated on at least one side.

6. A decorative hollow article according to claim 1 wherein the decorative hollow article includes two flaps in the area of the opening and said flaps are capable of hinging open and are of a like shape and dimension.

7. A decorative hollow article according to claim 6 wherein the removable liners can be peeled from the two flaps to expose the adhesive to enable it to be adhesively adhered to an object.

8. A composite of decorative hollow article according to claims 6 wherein the portions of the inner sides are of like shape and dimension, so that they line up together.

9. A decorative hollow article according to claim 6 further including a formed protrusion so that the article when adhered to an object will be able to attach to another object.

10. A decorative hollow article according to claim 6 wherein at least two sheets of flat, heat-sealable stock has been pre-formed into a three-dimensional molded shape.

11. The decorative hollow article defined in claim 1 wherein the liners project beyond the opening.

12. A decorative hollow article comprising:

at least two identical sheets of flat, heat-sealable stock, the sheets being provided with inner sides facing one another and having adhesive portions on the inner sides;

two removable liners covering the adhesive portions and interposed with one another; and a seal along a peripheral edge of said at least two sheets of flat, heat-sealable stock thereby forming a hollow cavity, open between the adhesive portions of the inner sides, which are attachable to one another upon removal of the liners.

* * * * *

UNITED STATES PATENT AND TRADEMARK OFFICE

CERTIFICATE OF CORRECTION

PATENT NO. : 6,506,465 B1
APPLICATION NO. : 09/318147
DATED : January 14, 2003
INVENTOR(S) : Sloot It is certified that error appears in the above-identified patent and that said Letters Patent is hereby corrected as shown below:

On the Title Pg, Item (57) Abstract, line 5: "remains open provides will" should read --remains open will--

Col. 7, line 10, claim 1: "with the adhesive;" should read --with the adhesive; and--

Signed and Sealed this

Ninth Day of March, 2010

David J. Kappos

David J. Kappos
*Director of the United States Patent and Trademark Office*